United States Patent [19]

Agatahama et al.

[11] 4,223,290

[45] Sep. 16, 1980

[54] ELECTROMAGNETIC DEVICE OF THE FLAT PACKAGE TYPE

[75] Inventors: Shunichi Agatahama, Osaka; Akio Masaki; Yoshihide Bando, both of Kyoto, all of Japan

[73] Assignee: Omron Tateisi Electronics Co., Kyoto, Japan

[21] Appl. No.: 968,028

[22] Filed: Dec. 8, 1978

[30] Foreign Application Priority Data

Dec. 24, 1977 [JP] Japan ..... 52/157095

[51] Int. Cl.[3] ..... H01F 7/02; H01H 51/22

[52] U.S. Cl. ..... 335/229; 335/80

[58] Field of Search ..... 335/229, 230, 234, 78, 335/79, 80, 128, 202, 203

[56] References Cited

U.S. PATENT DOCUMENTS

| | | | |
|---|---|---|---|
| 3,047,691 | 7/1962 | Kohoutek et al. | 335/80 |
| 3,048,678 | 8/1962 | Reed et al. | 335/80 |
| 3,906,416 | 9/1975 | Sprando | 335/128 |
| 3,993,971 | 11/1976 | Ono et al. | 335/202 |

*Primary Examiner*—Harold Broome

*Attorney, Agent, or Firm*—Stevens, Davis, Miller & Mosher

[57] ABSTRACT

A miniaturized electromagnetic device is disclosed, which is applicable to an electromagnetic relay of the flat package type.

The electromagnetic device comprises a magnetic core having the configuration of the capital letter H, a coil wound round the magnetic core, and a pair of magnetic members for alternatingly forming two closed magnetic circuits in cooperation with said magnetic core, said magnetic members being formed in one-piece with the aid of connecting members of non-magnetic material, one of said magnetic members including a permanent magnet, and each tip of said magnetic member confronting the corresponding tip of said magnetic core and the clearance therebetween being changeable by the magnetic force generated therebetween as said coil is energized.

6 Claims, 6 Drawing Figures

ELECTROMAGNETIC DEVICE OF THE FLAT PACKAGE TYPE

BACKGROUND OF THE INVENTION

This invention relates to an electromagnetic device to be used in, for example, an electromagnetic relay.

Recently, a magnetic relay to be miniaturized, preferably, as small as a package for semiconductor device such as a dual-in-line type IC has been required. To provide such an electromagnetic relay, a miniaturized, especially thinned, electromagnetic device for actuating contacts has been required. However, conventional electromagnetic devices are rather complex in construction, bulky and expensive to manufacture. For example, a movable unit or armature has been disposed over an energizing coil, so that the electromagnetic device is not effectively miniaturized in height.

Therefore, it is an object of this invention to provide a compact electromagnetic device, especially miniaturized in height, being substantially similar to a flat semiconductor device package.

Another object of this invention is to provide an electromagnetic device comprising a small number of structual units which can be easily assembled and, hence, at low cost.

Another object of this invention is to provide an electromagnetic device having stable operational characteristics against mechanical shock or vibration.

DETAILED DESCRIPTION OF THE PREFERRED EMBODIMENT

Figure 1:
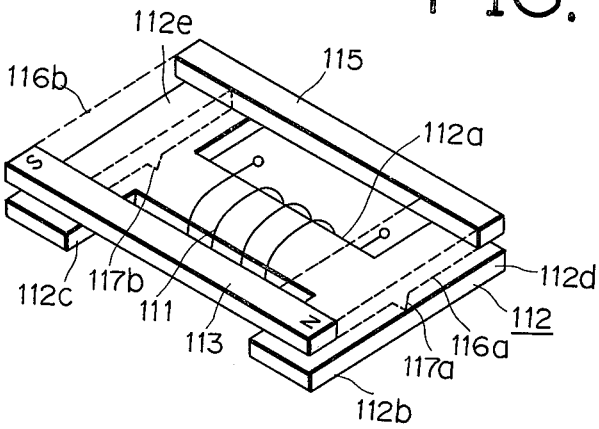
FIG. 1 through FIG. 6 are schematic perspective views showing a variety of constructions of the electromagnetic device according to this invention.

A fundamental construction of the electromagnetic device according to this invention is shown in FIG. 1. The device consists of a magnetic core 112, two magnetic members 113 and 115, and a coil 111. The magnetic core 112 has the configuration of the capital letter H consisting of a main core portion 112*a* and elongated core portions 112*b*, 112*c*, 112*d*, and 112*e* made of known soft magnetic plate material by stamping.

The coil 111 is wound round the main core portion 112*a* of the magnetic core 112. The magnetic members 113 and 115 disposed in parallel with said main core portion 112*a* for alternatingly forming two different magnetic circuits are formed in one-piece with the aid of connecting members 116*a* and 116*b* of non-magnetic materials such as a thermoplastic resin. Spaced equally from said magnetic members 113 and 115 and on the underside of said connecting members 116*a* and 116*b* there are respectively provided projections 117*a* and 117*b* which extend toward said magnetic core on assembly. A magnetic member 113 is a permanent magnet, and the other member 115 is not a permanent magnet but may be made of the same material as said magnetic core 112. As assembled, the tips of said magnetic members 113 and 115 confront the corresponding tips of said elongated portions 112*b* through 112*e*.

The magnetic members 113 and 115 as connected in one-piece by said connecting members 114*a* and 114*b* are disposed on said magnetic core 112 in such a manner that they are rotatable about said projections 117*a* and 117*b*, with the clearance between each tip of magnetic member 113 or 115 and the tip of the corresponding one of said elongated core portions 112*b* through 112*e* being varied by the rotation of said magnetic member.

When the coil 111 is not energized, said magnetic members 113 and 115 are rotated counterclockwise by the attractive force of magnetic member 113. The magnetic member 113 forms a closed magnetic circuit with elongated core portion 112*c*, main core portion 112*a* and elongated core portion 112*b*.

When coil 111 is energized and a magnetic flux is generated in the opposite direction to the magnetic flux caused by said magnetic member 113, the magnetic member 113 and the elongated core portions 112*b* and 112*c* repel each other, while the magnetic member 115 is attracted to elongated core portions 112*d* and 112*e*, with the result that magnetic members 113 and 115 rotate clockwise. Magnetic member 115 forms another closed magnetic circuit with main core portion 112*a* and elongated core portions 112*d* and 112*e*.

When coil 111 is deenergized, magnetic members 113 and 115 are rotated counterclockwise by the attractive force of magnetic member 113, thus reassuming the normal position.

From the above-mentioned description, those skilled in the art may easily understand that movable magnetic members 113 and 115 can be applied to an electromagnetic relay in which said members function as an armature of the conventional electromagnetic relay for actuating contacts.

Although, in this embodiment, magnetic core 112 is stationary and magnetic members 113 and 115 are movable, it will be obvious that taking an opposite combination is at the designer's descretion.

Figure 2:
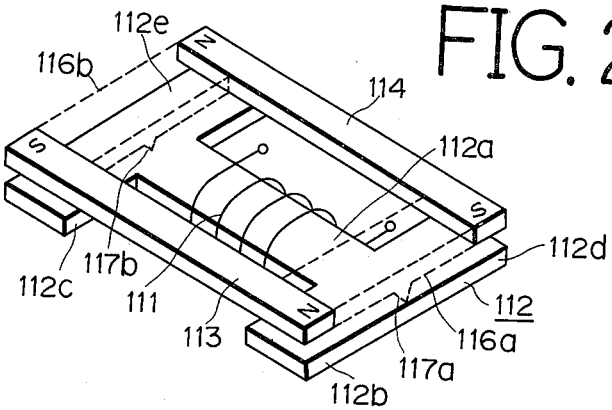

In FIGS. 1 through 6, like reference numerals represent the parts, except that the reference numeral 114 in FIG. 2 denotes a permanent magnet member similar to magnetic member 113.

Referring, now, to FIG. 2 which illustrates another embodiment wherein a bistable latching operation is accomplished. The magnetic member 114 is disposed in such a manner that the direction of magnetic poles is opposite to that of the member 113.

Bistable latching operation is performed in this embodiment as described below.

When coil 111 is energized in one direction, one of magnetic members, for example 113, is attracted to elongated core portions 112*b* and 112*c*, while another magnetic member 114 and elongated core portions 112*d* and 112*e* repel each other since the direction of magnetic polarity of said member 114 is opposite to that of member 113, so that said members 113 and 114 rotate counterclockwise and are then held stationary.

Once said member 113 is attracted to said elongated core portions 112*b* and 112*c*, the attracted state remains even if said coil is deenergized.

However, if coil 111 is energized in another direction, said member 113 and elongated core portions 112*b* and 112*c* repel each other, while said member 114 is attracted to said elongated core portions 112*d* and 112*e*, so that members 113 and 114 rotate clockwise and are then held stationary in that position even if said coil is deenergized.

Figure 3:
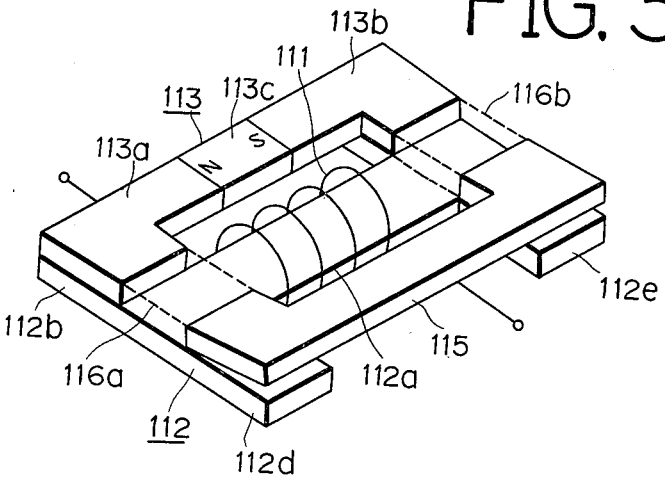

In FIG. 3 which shows another embodiment of this invention, a magnetic member 113 consists of a small permanent magnet 113*c* and a couple of divided magnetic members 113*a* and 113*b* each having the configuration of the capital letter L which are assembled in one-piece with, for example, cement.

The magnetic members 113 and 115 are connected by connecting members 116*a* and 116*b* at an obtuse angle, for example as shown in FIG. 3, so as to avoid a leakage of magnetic flux, i.e. for applying a large magnetic force between said magnetic members 113 and 115 and elongated core portions 112*b* through 112*d*.

If the latching operation described above with reference to FIG. 2 is required, a permanent magnet is employed also for magnetic member 115.

Figure 4:
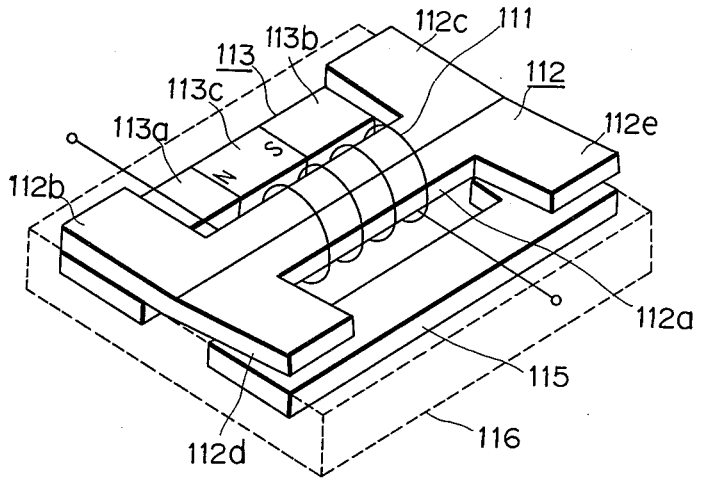

In another embodiment shown in FIG. 4 magnetic members 113 and 115 are stationary and magnetic core 112 is rotatable. Magnetic core 112 is longitudinally bent to form a obtuse angled for the same reason described above.

Magnetic members 113 and 115 are partially embedded in a plastic member 116 which may be used as a part of a housing for accomodating an electromagnetic device.

Coil 111 is rotatable together with said magnetic core 112, although it may be held stationary, if desired.

Figure 5:
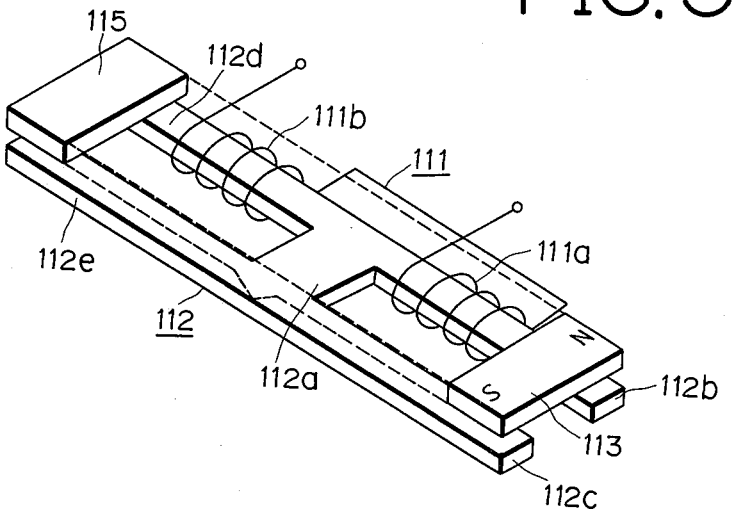

In another embodiment shown in FIG. 5, coil 111 is divided into two parts, 111*a* and 111*b*. The operation of this embodiment is similar to that of the embodiment shown in FIG. 1. If the latching operation above-described is required, magnetic member 115 must be replaced by a permanent magnet.

The placement of the coil 111 in other positions with respect to elongated core portions is optional and such positions can be freely selected within the scope of this invention.

Figure 6:
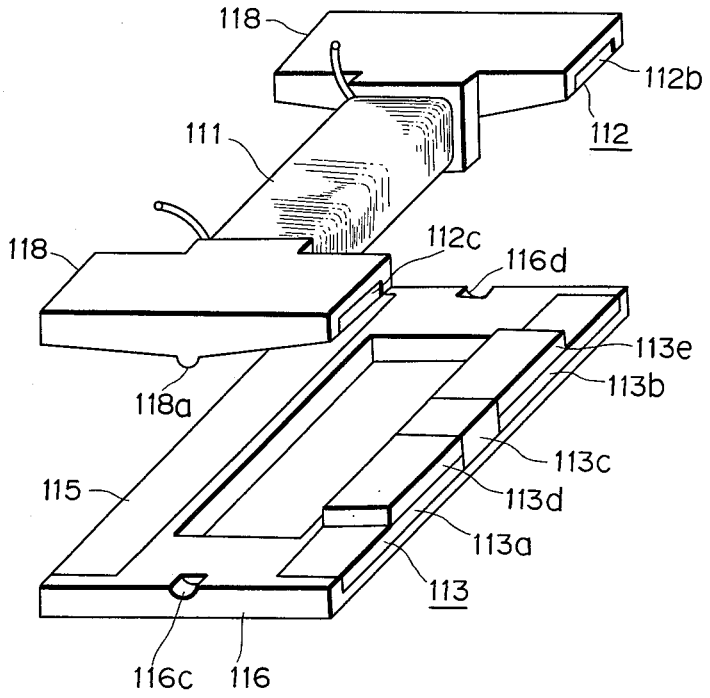

FIG. 6 shows a practical feature of the electromagnetic device according to this invention.

Magnetic core 112 is partially embedded in a plastic member 118, and coil 111 is wound thereon.

Magnetic members 113 and 115 are embedded in plastic member 116. Magnetic member 113 consists of four divided members 113*a*, 113*b*, 113*d*, and 113*e* as well as a permanent magnet 113*c*, all cemented together. The divided members 113*d* and 113*e* are useful for reducing the magnetic reluctance of magnetic member 113.

The projections 118*a* and 118*b* (the latter hidden behind plastic member 118) formed on said plastic member 118 are rotatably engaged with two recesses 116*c* and 116*d* formed on plastic member 116.

Coil 111 projects into a space between magnetic members 113 and 115, and permanent magnet 113*c* and two divided members 113*d* and 113*e* project into a space between elongated magnetic cores 112*b* and 112*c*, thus an effectively miniaturized electromagnetic device with stable operational characteristics is provided.

As described above with reference to FIG. 1 through FIG. 6, the electromagnetic device according to this invention is compact, the schematic external shape of which is similar to two stacked plates. Said electromagnetic device with a few main structural elements can be easily assembled and manufactured at low cost. Moreover, said electromagnetic device is excellent in anti-shock characteristics since the shape of said movable magnetic core or magnetic members are symmetric.

What is claimed is:

1. An electromagnetic device comprising:

a stationary H-shaped substantially planar magnetic core consisting of a main core portion and four elongated end portions extending from said main core portion;

a pair of substantially planar magnetic members for alternately forming two closed magnetic circuits in cooperation with said magnetic core, at least a part of at least one of said magnetic members being comprised of a permanent magnet, said magnetic members being disposed in parallel with said main core portion and being integrally connected through a non-magnetic material to form an integral flat planar unit rotatable about a line parallel to said magnetic members, the tips of each of said magnetic members confronting the corresponding tips of said elongated core portions, the clearance between the tips of each magnetic members and the tips of the corresponding elongated core portions being changeable; and, a coil wound around a portion of said magnetic core for varying said clearance upon energization.

2. An electromagnetic device according to claim 1, wherein said coil is wound round said main core portion of said magnetic core.

3. An electromagnetic device according to claim 1, wherein said coil is wound round at least one of said elongated core portions.

4. An electromagnetic device according to claim 1, wherein each tip of said magnetic members and the corresponding tip of an elongated core member are attracted to each other by a magnetic force into mutually confronting, parallel relationship over a certain area.

5. An electromagnetic device according to claim 1, wherein both of said magnetic members include a permanent magnet, the directions of magnetic poles of which are different and in parallel with said main core portion.

6. An electromagnetic device comprising an H-shaped magnetic core having a main core portion and four elongated end portions extending from said main core portion;

an integral magnetic device including a pair of elongated magnetic members for alternately forming two closed magnetic circuits in cooperation with said magnetic core, said magnetic members being disposed in parallel with said main core portion and being interconnected by non-magnetic material, the tips of each of said magnetic members confronting the corresponding tips of said elongated core portions, the clearance between the tips of each magnetic member and the tips of corresponding elongated core portions being changeable, at least one of said magnetic members including a central permanent magnet portion and, at respective opposite sides thereof, first and second pairs of divided magnetic member portions connected to said permanent magnet portion;

means for permitting relative rotation between said magnetic core and magnetic device to change the clearance between the tips of each magnetic member and the tips of corresponding elongated core portions; and, a coil wound around the main core portion of said magnetic core for causing relative rotation between said magnetic core and magnetic device upon energization thereof.

* * * * *